US006578340B2

(12) United States Patent
Ishikawa et al.

(10) Patent No.: US 6,578,340 B2
(45) Date of Patent: Jun. 17, 2003

(54) WALL STRUCTURE OF BUILDING

(75) Inventors: Masayoshi Ishikawa, Kurobe (JP); Masami Takemura, Kurobe (JP); Tsutomu Takahashi, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/927,365

(22) Filed: Aug. 13, 2001

(65) Prior Publication Data

US 2002/0020121 A1 Feb. 21, 2002

(30) Foreign Application Priority Data

Aug. 14, 2000 (JP) ..... 2000-245778

(51) Int. Cl.[7] ..... E04B 2/28
(52) U.S. Cl. ..... 52/654.1; 52/235; 52/466
(58) Field of Search ..... 52/235, 466, 654.1

(56) References Cited

U.S. PATENT DOCUMENTS 4,619,092 A * 10/1986 Kaminaga ..... 49/DIG. 1
4,724,637 A * 2/1988 Evans ..... 52/204.591
4,996,809 A * 3/1991 Beard ..... 52/200
5,235,790 A * 8/1993 Ishikawa et al. ..... 52/235
5,309,689 A * 5/1994 Croissant ..... 52/235
5,369,924 A * 12/1994 Neudorf ..... 52/200
6,158,182 A * 12/2000 Biebuyck ..... 52/204.53

FOREIGN PATENT DOCUMENTS

JP 10-131365 5/1998

* cited by examiner

*Primary Examiner*—Carl D. Friedman
*Assistant Examiner*—Basil Katcheves
(74) *Attorney, Agent, or Firm*—Finnegan, Henderson, Farabow, Garrett, & Dunner, L.L.P.

(57) ABSTRACT

Depth of an inner batten (50C) is reduced and an indoor space (A) is covered with a cover member (60), so that, though the cover member (60) is attached to conceal a lower side of a transom (20C) from an indoor side in a vision portion, the cover member (60) can be omitted in a spandrel portion where the lower side of the transom (20C) cannot be seen in order to reduce production cost, and, even after the inner batten (50C) is attached to the transom (20C), cutoff treatment can be easily conducted before attaching the cover member (60), thereby obtaining stable cutoff performance by checking coating condition of a sealing material (90).

2 Claims, 7 Drawing Sheets

WALL STRUCTURE OF BUILDING

BACKGROUND OF THE INVENTION

1. Field of the Invention

The present invention relates to a wall structure of a building, which can be suitably used for a knockdown-type curtain wall of which mullions, transoms, facing members, battens etc. are independently transferred to a construction sites to form exterior wall.

2. Description of Related Art

Conventionally, following two methods are known for constructing facing members such as glass plate and aluminum panel in the above knockdown-type curtain wall.

One method is outside glazing for fitting the facing member to a section formed by mullions and transoms from the outdoor side. The other is inside glazing for fitting the facing member from the indoor side.

The inside glazing is mainly used for a building where a scaffold is difficult to be set up. However, since the facing member cannot be always fitted from the indoor side when there is an obstacle such as a pillar on the indoor side, the outside glazing and the inside glazing may sometimes be combined in a single building.

Incidentally, when the facing member is fitted by the inside glazing, lower periphery of the facing member is held by a holding groove provided on the lower transom and the upper periphery of the facing member is held by a holding piece provided on the outdoor side of the upper transom and an inner batten attached to the transom from the indoor side. The inner batten is attached to the transom by engaging indoor-side end of the inner batten to the indoor-side end of the transom and by engaging the outdoor-side end of the inner batten to a neighborhood of a location for the facing member to be disposed, as shown in U.S. Pat. No. 5,309,689 and Japanese Patent Laid-Open Publication No. Hei 10-131365.

Accordingly, the depth dimension of the inner batten becomes large equaling to the depth dimension of the transom subtracted by a slight part used for connection with the facing member, so that the lower side of the transom is substantially completely concealed by the inner batten. Therefore, the lower side of the transom having no design is not exposed to the indoor space, thus maintaining good appearance of the curtain wall.

On the other hand, an ordinary curtain wall has a vision portion using a facing member composed of glass plate etc. for lighting and a spandrel portion corresponding to a spandrel wall and a hanging wall provided to a slab of a building. Though the inner batten attached to the transom can be seen from indoor in the vision portion, the inner batten as well as the transom is not exposed to the indoor space on account of the presence of the spandrel wall and the hanging wall on the indoor side.

Accordingly, if the inner batten having great depth is used in the spandrel portion without exposing the transom and the inner batten in the same manner as in the vision portion, the component cost cannot be reduced.

Further, in a conventional curtain wall covering the lower side of the transom by the large inner batten, cutoff (waterproofing) treatment is conducted to the gap between both longitudinal ends of the inner batten and the mullions on both sides with a wet seal material irrespective of distinction of the vision portion and the spandrel portion. The cutoff treatment is conducted by piling the seal material up on the backside of both ends of the inner batten in advance and bringing the both ends of the inner batten in contact with the mullion.

However, since the seal material is located on the backside of the inner batten after attaching the inner batten to the transom, the condition of cutoff treatment cannot be checked, so that cutoff performance can become uneven.

SUMMARY OF THE INVENTION

An object of the present invention is to provide a wall structure of a building capable of reducing component cost and obtaining stable cutoff performance.

A wall structure of a building according to an aspect of the present invention includes a facing member disposed in a section formed by left and right mullions and upper and lower transoms and an inner batten engaged to the mullion and/or the transom to hold the facing member from an indoor side, in which a cover for covering an indoor side of the inner batten facing the section formed by the mullion and/or the transom is attachably provided.

According to the present invention, since the cover member conceals, for instance, lower side of the mullion and transom, the inner batten itself may be sized to hold the facing member and may have smaller depth dimension than conventional arts. Further, since the cover member is independent of the inner batten, the cover member is not necessarily attached to a portion such as a spandrel portion of a curtain wall where even transom is not exposed. Accordingly, only the inner batten of smaller depth dimension is provided to the spandrel portion and a large cover member as compared to the inner batten is not required, so that production cost therefor can be reduced.

Further, since the depth dimension of the inner batten is reduced, the cutoff treatment between the mullion or the transom and the inner batten can be conducted after attaching the inner batten. In other words, since a space for attaching the cover member is formed on the indoor side of the inner batten, the seal material can be filled after attaching the inner batten using the space. The space can also be used for checking the condition after cutoff treatment, so that cutoff treatment may be conducted again when the condition is bad, thereby stabilizing cutoff performance.

In the above aspect of the wall structure of a building according to the present invention, a holding piece may preferably be provided to an outdoor side of the mullion and/or the transom for holding the facing member from the outdoor side, an outdoor surface of the holding piece having a mark indicating a cutting position of the holding piece, an indoor surface of the holding piece having an engaging portion to be engaged with a post-attached outer batten in place of the cut holding piece, wherein the mark is provided inwardly in width direction relative to the engaging portion.

In other words, even in a curtain wall of inside glazing using the inner batten, the facing member has to be exchanged from the outdoor side on the spandrel portion on account of presence of spandrel and hanging wall. Further, even in vision portion, when an interior material such as casing and curtain box is disposed on immediately indoor side of the transom, since the inner batten is difficult to be detached on account of the interior material, the facing member has to be exchanged from the outdoor side. When the facing member is exchanged, a part of the holding piece of the transom or the mullion is cut from the outdoor side.

However, in cutting the holding piece, the engaging portion of the post-attached outer batten provided on the indoor side of the holding piece can be simultaneously cut. It is strongly desired to eliminate such error during cutting work.

In the present invention, a mark indicating the cutting position is provided on the outdoor side of the holding piece of the curtain wall and the cutting work is conducted along the mark. The mark is provided inward in depth direction relative to the engaging portion.

According to the above arrangement, when the holding piece is cut with, for instance, a hand tool such as a grinder, the engaging portion on the indoor side is not mistakenly cut by cutting along the mark. Accordingly, the holding piece can be easily and securely cut, thus improving workability.

In the above aspect of the wall structure of a building according to the present invention, the facing member may preferably be held by the inner batten and the holding piece through seal members provided on the indoor side and the outdoor side respectively, the seal members having held portions of the same thickness in depth direction.

Conventional inside glazing curtain wall has an outdoor-side seal member pre-attached to the holding piece of the mullion or the transom and an indoor-side seal member fitted between the facing member and the batten after being disposed. The portion held between the holding piece of the pre-attached seal member and the facing member has thickness different from the portion held between the facing member and the inner batten of the post-attached seal member. However, since the pre-attached seal member is disposed on the indoor side and the post-attached seal member is fitted on the outdoor side when the facing member is exchanged from the outdoor side by cutting the holding piece of the mullion or the transom, thickness of the seal member on the indoor and the outdoor side is reversed relative to the other portion without exchanging the facing member, so that the position of the facing member in the depth direction becomes different to impair appearance thereof.

On the other hand, according to the wall structure of a building of the present invention, since the thickness of the indoor seal member and the outdoor seal member, i.e. the pre-attached seal member and the post-attached seal member, is the same, the position of the facing member of the portion exchanging facing member thereof is consistent with the portion without exchanging the facing member in the depth direction, thereby improving appearance thereof.

DETAILED DESCRIPTION OF PREFERRED EMBODIMENT(S)

An embodiment of the present invention will be described below with reference to attached drawings.

Figure 1:
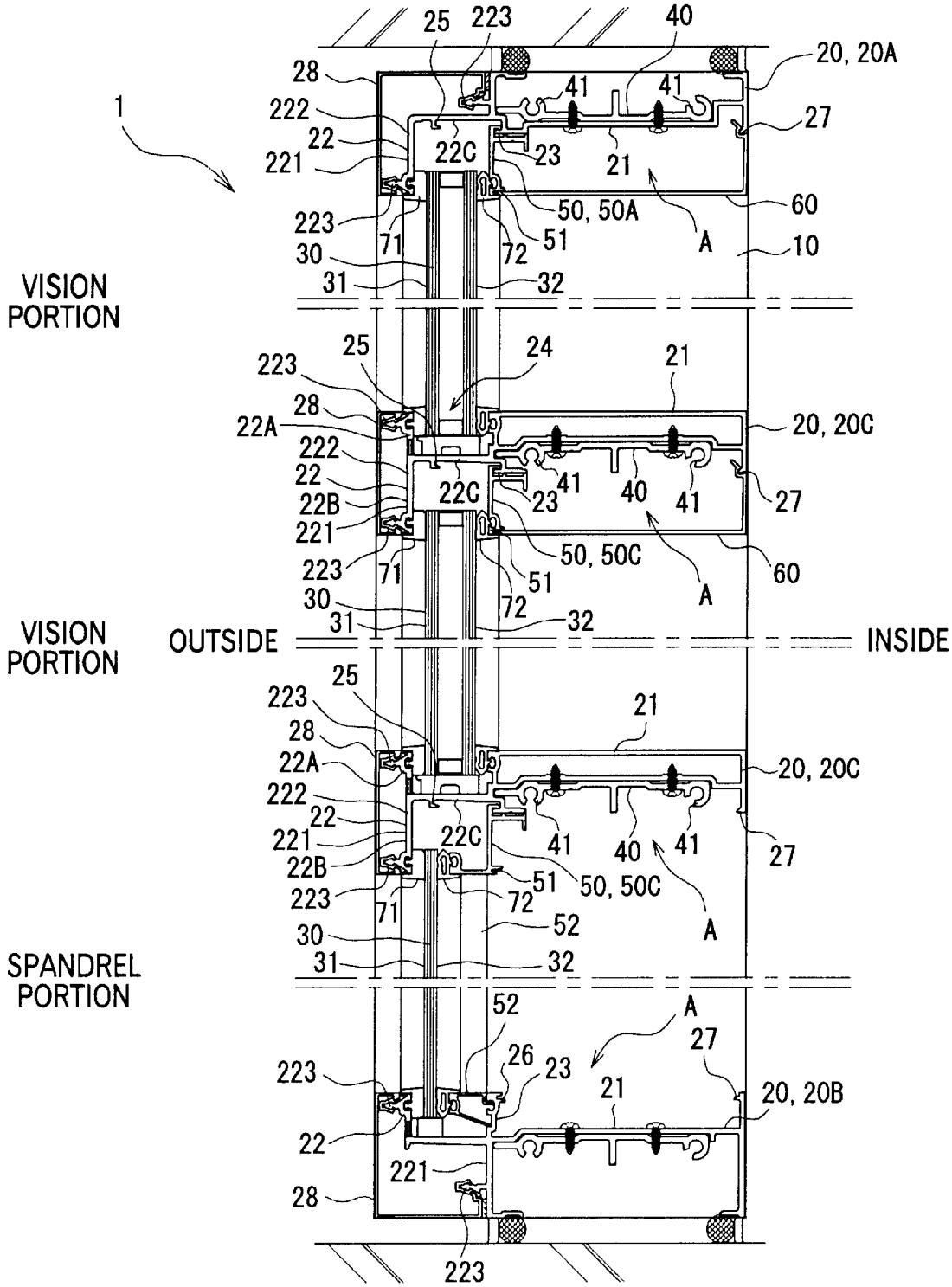
FIG. 1 is a vertical cross section showing a curtain wall applied with a wall structure according to an embodiment of the present invention.
Figure 2:
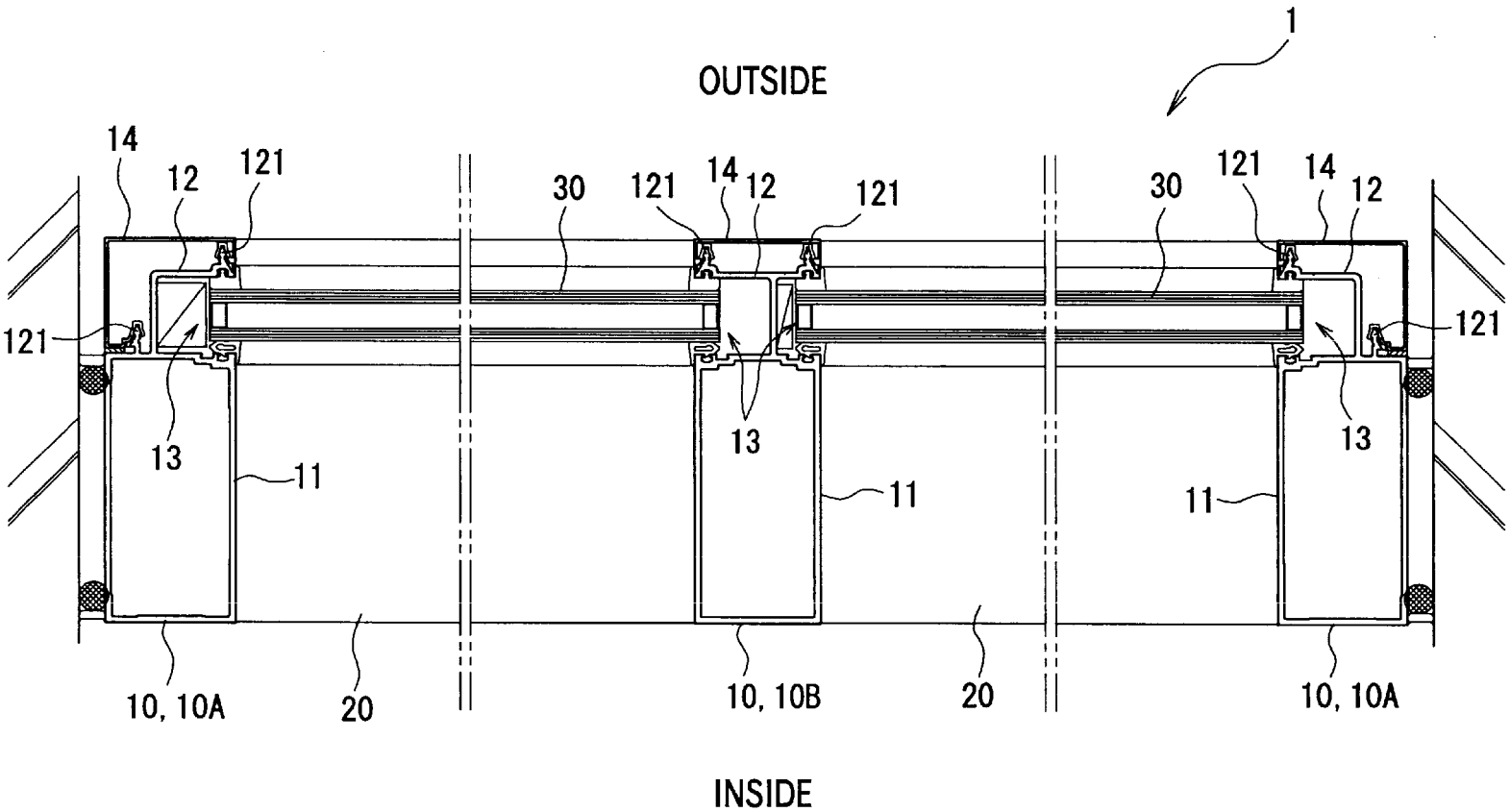
FIG. 2 is a horizontal cross section of the aforesaid embodiment.

FIG. 1 is a vertical cross section showing a curtain wall applied with a wall structure according to the present embodiment, and FIG. 2 is a horizontal cross section of the curtain wall 1.

The curtain wall 1 has a plurality of vertical mullions 10 spaced apart with each other, a plurality of horizontal transoms 20 extending between the mullions 10 vertically spaced apart with each other, a facing member disposed in a section formed by the right and left mullions 10 and the upper and lower transoms 20, i.e. single-glazing or double-glazing glass plate 30. The curtain wall 1 is a knockdown type formed by the mullions 10, the transoms 20 and the glass plates 30 independently carried to a construction site, and is an inside-glazing type in which the glass plate 30 is fitted from the indoor side.

As shown in FIG. 2, the mullion 10 includes a mullion 10A vertically provided on the right and left ends of the curtain wall 1 and a plurality of mullions 10B vertically provided between the mullions 10A (only one of the mullions 10B is shown in FIG. 2), the mullion 10A and the mullion 10B having different cross section.

The mullions 10A and 10B are made of aluminum extrusion and have a hollow body 11 and a holding piece 12 provided on the outdoor side of the body 11. The right and left mullions 10A have L-shaped holding piece 12, where distal ends of the holding pieces 12 mutually opposes. The holding piece 12 of the mullion 10B is formed in approximate T-shape having distal ends projected in both right and left directions.

A vertically extending periphery of the glass plate 30 is fitted and held in a holding groove 13 that is formed by the holding piece 12 and the body 11.

Two projections 121 projecting toward the outdoor side are provided to the holding piece 12 and a decorative panel 14 is engaged to the projections 121. As shown in FIG. 1, the transom 20 includes a transom 20A disposed on upper end of the curtain wall 1, a transom 20B disposed on lower end of the curtain wall 1 and a plurality of transoms 20C disposed between the transom 20A and 20B (only two transoms 20C are shown in FIG. 1), the transoms 20A, 20B and 20C respectively having different cross sections.

Figure 3:
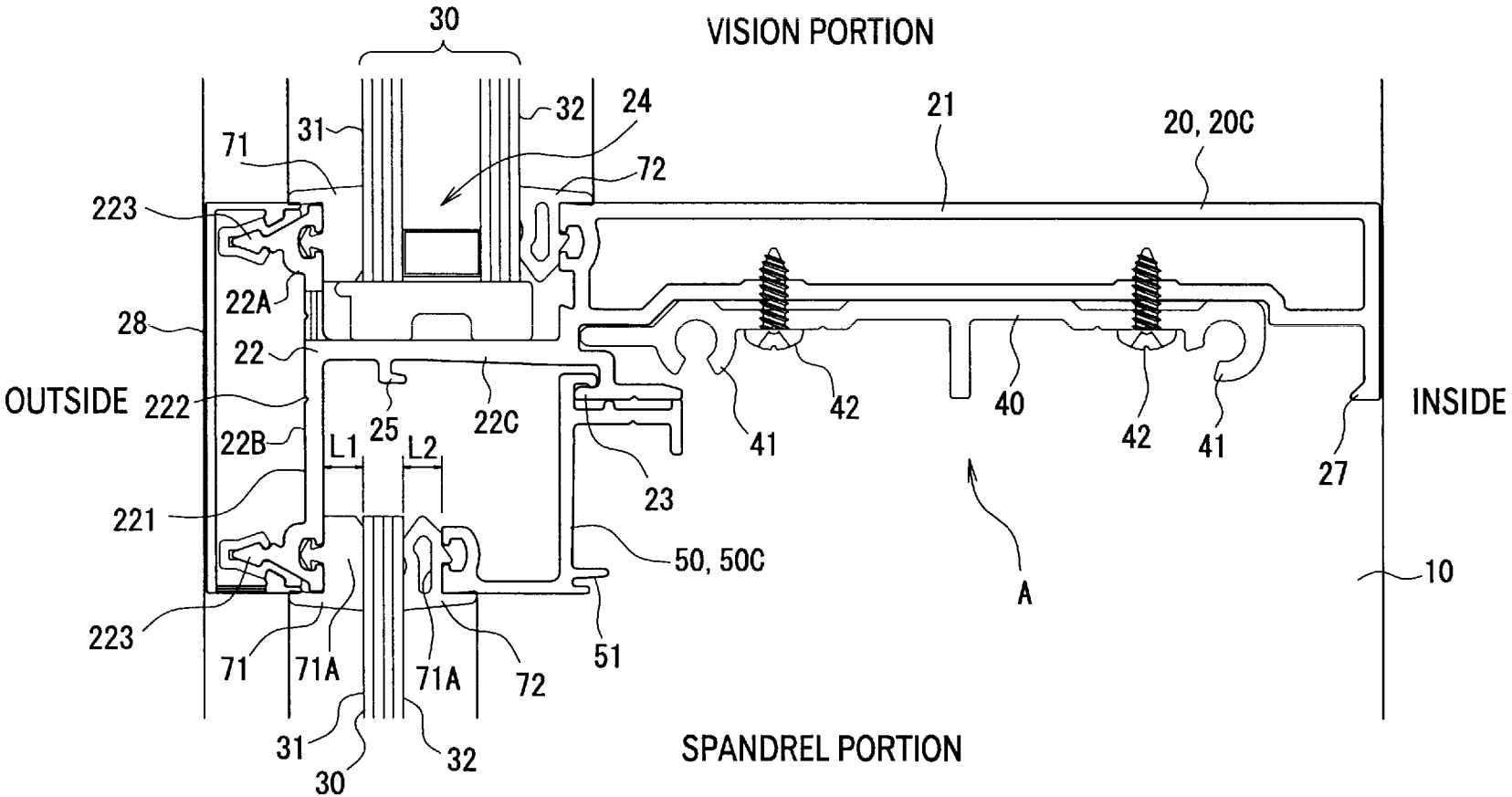
FIG. 3 is a vertical cross section enlarging a primary portion of the aforesaid embodiment.
Figure 4:
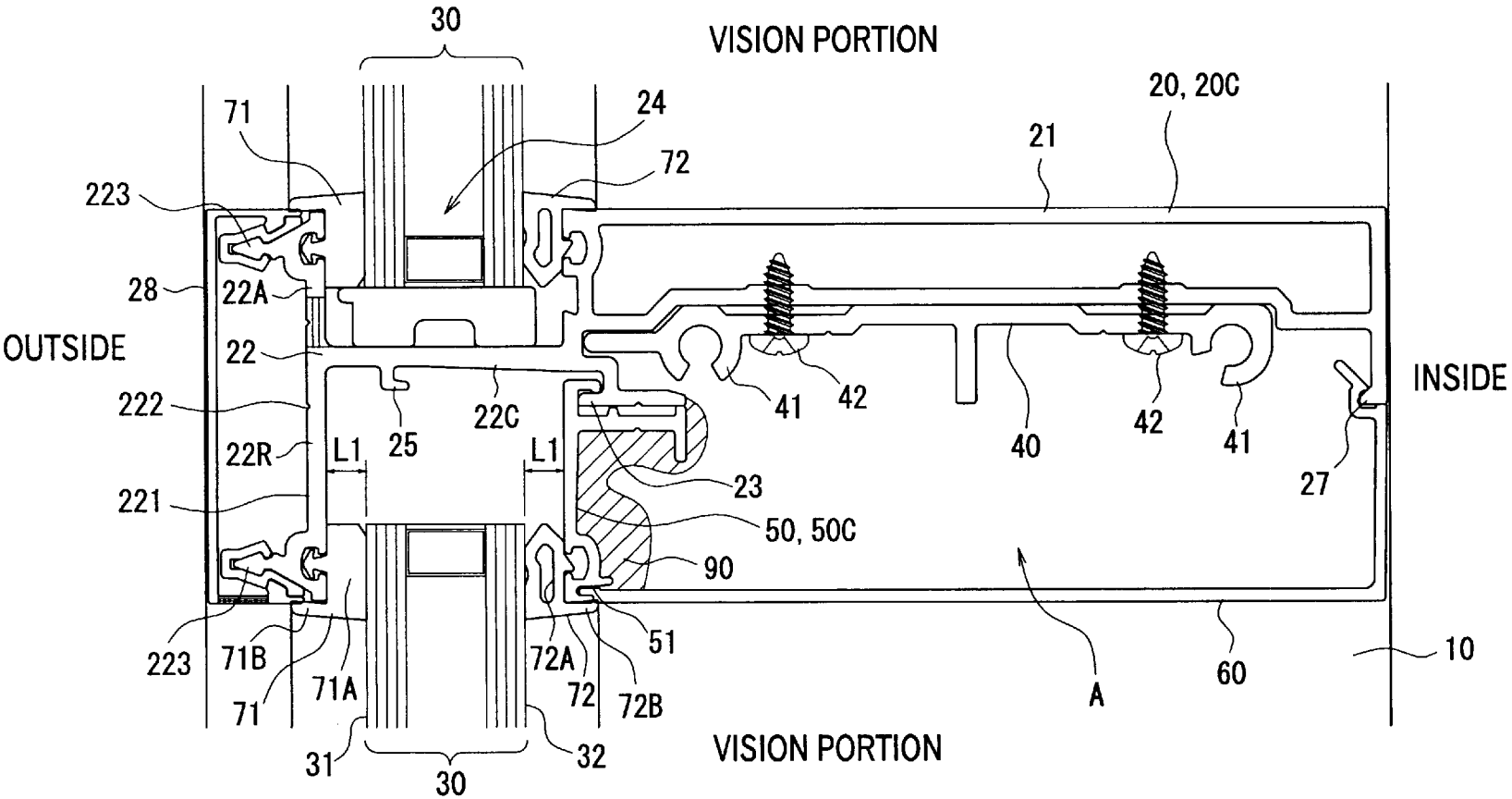
FIG. 4 is a vertical cross section showing another primary portion of the aforesaid embodiment.

As enlarged in FIGS. 3 and 4, the transoms 20A to 20C are made of aluminum extrusion and are fixed to the mullion 10 through an attachment 40 provided with a pair of vis holes 41, the transoms 20A to 20C being composed of a body 21 fixed to the attachment 40 by a vis 42 and a holding piece 22 provided on the outdoor side of the body 21. The holding piece 22 of the transom 20A has an L-shape with distal end thereof being bent downward. The holding piece 22 of the transom 20B has an L-shape with distal end thereof being bent upward. The holding piece 22 of the transom 20C has approximate T-shape of which distal end projecting both in up and down directions.

A first engaging portion 23 is provided to a lower side and outdoor side of the body of the transom 20A, and an inner batten 50 (50A) is engaged to the engaging portion 23. The inner batten 50A and the holding piece 22 hold a horizontally extending upper periphery of the glass plate 30.

The first engaging portion 23 projecting approximately vertically toward the outdoor side of the body is provided to the transom 20B and a glazing adapter 52 is engaged to the engaging portion 23. The glazing adapter 52 and the holding piece 22 hold a horizontally extending lower periphery of the glass plate 30. However, the glazing adapter 52 is also used for the right and left mullions 10, so that the vertical periphery of the glass plate 30 is also held by the glazing adapter 52. This is because the single-glazing glass plate 30 is fitted on the spandrel portion.

In the transom 20C, the lower periphery of the upside glass plate 30 is held by a holding groove 24 formed by a rising piece 22A of the holding piece 22 and the body 21. On the other hand, the first engaging portion 23 is provided to the lower side of the body 21, so that the upper periphery of the downside glass plate 30 is held by the inner batten 50 (50C) engaged to the engaging portion 23 and a hanging piece 22B of the holding piece 22.

Among the transoms 20A to 20C, as represented by the holding piece 22 of the transom 20C in FIGS. 3 and 4, the holding piece 22 of the transoms 20A and 20C is provided with a second engaging portion 25 on a horizontal portion 22C. The second engaging portion 25 is for an outer batten for holding an exchanged glass plate fitted from outside when the glass plate 30 is exchanged. The outer batten will be described below.

An outdoor side 221 of the hanging portion 22B as a part of the holding piece 22 is provided with a groove 222 as a longitudinally continuing mark. The groove 222 is an indication of a cutting position for a worker to cut the holding piece 22 in exchanging the glass plate 30 from the outside. The groove 222 is shifted toward an inside in the width direction relative to the second engaging portion 25, i.e. in a lower position in vertical direction in FIG. 3 for preventing an erroneous contact of a blade of a tool with the second engaging portion 25 in cutting along the groove 222. Such groove 222 may also be provided to the rising portion 22A as necessary, and may also be provided to the holding piece 22 of the transom 20A (FIG. 1).

A projection 223 projecting toward the outdoor side is provided on both up and down sides of the outdoor side 221 and a decorative panel 28 is engaged to the projection 223.

The decorative panel 28 is attached to the transoms 20A and 20B (FIG. 1) with its shape modified.

The inner batten 50 (50A, 50C) is an elongated member having small depth dimension. A large space A is formed on the indoor side of the inner battens 50A and 50C.

Further, though one of the two inner battens 50C used in the vision portion has the same cross section as the inner batten 50A, the other used in the spandrel portion has a lower end cross section slightly different from the inner batten 50A because of the single-glazing arrangement of the glass plate 30 held thereby.

The glazing adapter 52 used on the lower side of the curtain wall 1 approximately completely enters between the glass plate 30 and the first engaging portion 23 and has a cross section greatly different from the inner batten 50A and 50C. A large space A is formed on the indoor side of the first engaging portion 23 on account of absence of the portion forming the inner batten.

Third engaging portions 51 and 26 are provided on the lower end of the inner battens 50A and 50C and the upper end of the first engaging portion 23. Fourth engaging portion 27 is provided on the outdoor end of the body 21 of the transoms 20A to 20C. In the present embodiment, a cover member 60 having approximately L-shaped cross section engages and extends between the third engaging portion 51 and the fourth engaging portion 27 in the section forming the vision portion, i.e. in the space A.

The cover member 60 covers lower side of the transom 20A and the body 21 of the upper transom 20C, specifically, a portion on the inner side of the inner battens 50A and 50C and facing the sectioned portion to prevent the portion from being exposed to the indoor space.

On the other hand, since there is spandrel wall (not shown) on the indoor side in the spandrel portion, the portion having no design effect such as the upper side of the transom 20B and the lower side of the transom 20C, so that the cover member 60 for concealing the upper and lower portions are not attached.

In FIGS. 1 to 4, a pre-attached seal member (glazing bead) 71 is provided between the outdoor side 31 of the glass plate 30 and the holding pieces 12 and 22 of the transoms 20A, 20B and 20C, and a post-attached seal member (glazing bead) 72 is provided between the indoor side 32 of the glass plate 30 and the body 11, inner battens 50A, 50C and glazing adapter 52.

The seal members 71 and 72 of the present embodiment have a length corresponding to respective peripheries of the glass plate 30, however, a single continuously surrounding elongated member may be used.

The pre-attached seal member 71 has a solid cross section and the post-attached seal member 72 has a hollow cross section. The seal member 72 is hollow because the hollow body can be easily deformed in fitting and post-attaching the seal member 72 between the glass plate 30 and the body 11, inner battens 50A, 50C and glazing adapter 52, thus facilitating fitting the seal member.

However, though the seal members 71 and 72 have different cross section, as shown in FIGS. 3 and 4, a held portion 71A of the outdoor-side seal member 71 held between the glass plate 30 and the holding pieces 12 and 22 and a held portion 72A of the indoor-side seal member 72 held between the glass plate 30 and the body 11, the inner battens 50A and 50C and the glazing adapter 52 have the same thickness L1 and L2 in depth direction.

Further, respective seal members 71 and 72 are provided with fin portions 71B and 72B having the same shape, thereby obtaining the same appearance.

Figure 5:
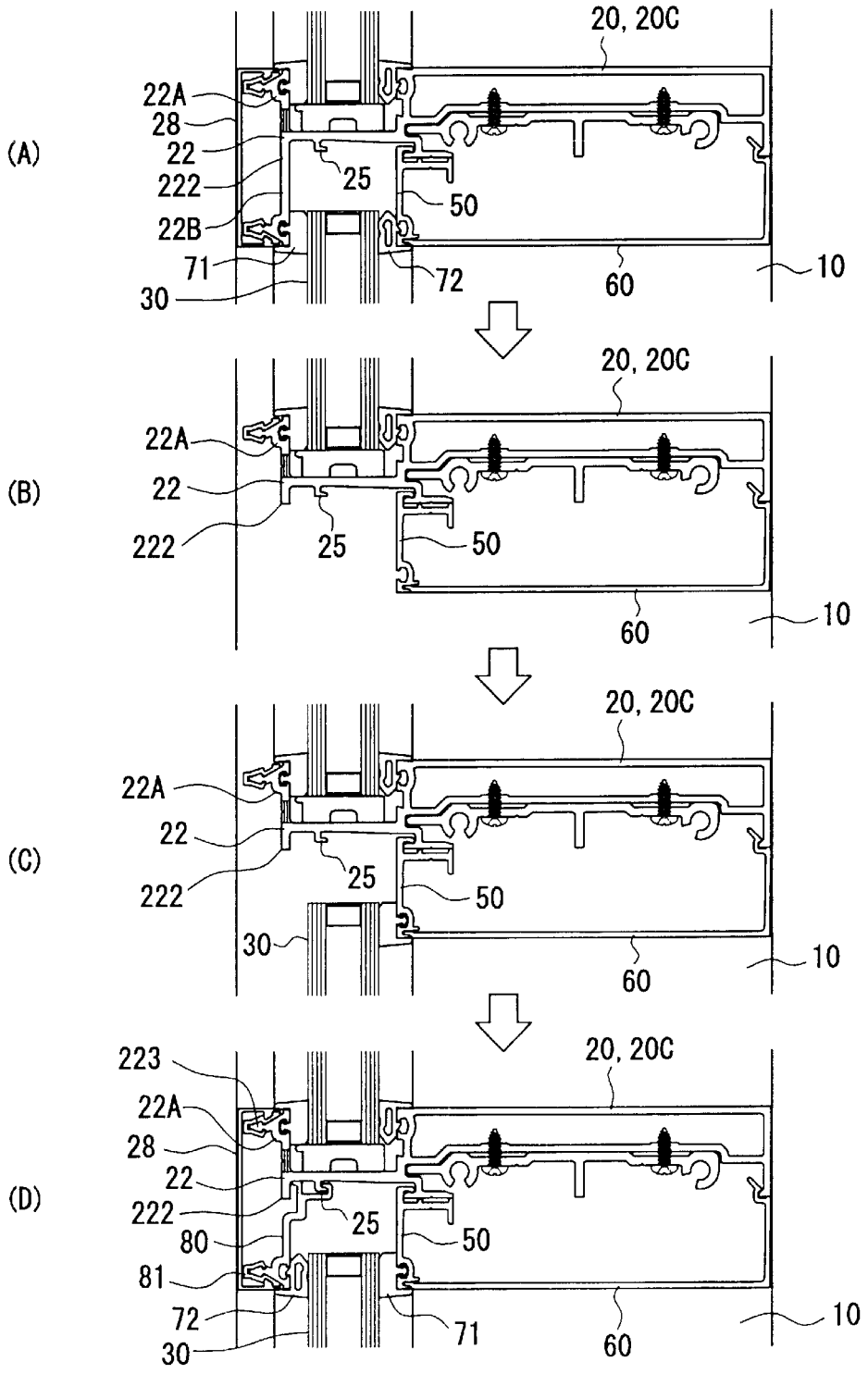
FIG. 5 is an illustration showing exchange steps of facing member of the aforesaid embodiment.

FIG. 5 shows process for exchanging the glass plate 30 of the vision portion provided with the transom 20C, the inner batten 50C and the cover member 60. The process is applied for an arrangement where an interior material such as a casing and a curtain box is disposed immediately on the indoor-side of the transom 20C and exchange work from the indoor-side cannot be conducted. Though not shown and described, the glass plate 30 is exchanged in the spandrel portion having the spandrel and hanging wall on the indoor-side in a manner approximately the same as below.

In FIG. 5(A), when the glass plate 30 is damaged and necessary to be exchanged, after the decorative panel 28 is initially detached, the holding piece 22 (or the hanging piece 22B thereof) of the transom 20C is cut using a tool such as a grinder. The worker sees the groove 222 provided on the holding piece 22 as a mark and pay attention not to cut a portion upper than the groove 222.

Subsequently, together with the cut holding piece 22, the outdoor-side pre-attached seal member 71 engaged to the holding piece 22 is removed. Subsequently, the glass plate 30 is brought upwardly to detach lower periphery thereof from a holding groove of a lower transom (not shown) and also detach the vertical periphery from the holding groove of the mullion 10 on both sides by slide movement in either one of right and left direction and subsequent movement in the other direction, thereby removing the glass place 30 from the vision portion. Subsequently, the post-attached seal member 72 on the indoor side is removed.

Next, in FIG. 5(C), the seal member 71 provided ordinarily on the indoor-side is engaged and pre-attached to the inner batten 50C on the indoor-side, the body of the mullion 10, and the lower transom (not shown) and a new glass plate 30 is fitted thereafter. While keeping the above condition, the outer batten 80 is engaged to the transom 20C using the second engaging portion 25. Stocked repair member may be used as the outer batten 80.

In FIG. 5(D), the post-attached seal member 72 ordinarily provided on the indoor-side is fitted between the glass plate 30 and the outer batten 80, the holding piece 22 and the holding piece of the lower transom (not shown). Finally, original decorative panel 28 is attached to the projection 223 remaining on the transom 29C and a projection 81 provided on the outer batten 80.

The exchange work of the glass plate 30 is completed as in the above.

According to the present embodiment, following advantages can be obtained.

(1) The cover member 60 can be attached to the transoms 20A and 20C of the curtain wall 1 and the inner battens 50A and 50C engaged thereto in a manner that the cover member 60 spans over the engaging portion 51 of the inner battens 50A and 50C and the engaging portion 27 of the transoms 20A and 20C. However, the cover member 60 may only be attached to a section such as the vision portion where the transoms 20A and 20C are seen from the indoor side to keep good appearance and the cover member 60 can be omitted at a portion such as the spandrel portion where the lower side of the transom 20C cannot be seen.

In the same manner, in the transom 20B of the spandrel portion and the glazing adapter 52, since the upper side of the transom 20B is not seen from the indoor-side, a cover member is not required between the engaging portions 26 and 27 of the transom 20B and the single-glazing glass plate 30 may be held by providing a dedicated glazing adapter 52 on the outdoor-side of the engaging portion 26.

Accordingly, inner batten 50C and the glazing adapter 52 having small depth may be provided in the spandrel portion and the cover member 60 relatively larger than the inner batten 50C and the glazing adapter 52 is not required, thus reducing production cost therefor.

(2) Since the width dimension of the inner batten 50A and 50C is small, large space A can be formed immediately on the indoor-side of the inner battens 50A and 50C. Accordingly, cutoff treatment by coating wet seal member 90 (shown in slanting lines in FIG. 4) spanning between the inner battens 50A and 50C and the right and left mullions 10 can be easily conducted from the space A side before attaching the cover member 60 even after the inner battens 50A and 50C are attached to the transoms 20A and 20C. Accordingly, the coating condition of the seal member 90 can be securely checked, thereby obtaining stable cutoff performance.

(3) Since the groove 222 indicating cutting position is provided on the outdoor side 221 of the holding piece 22 of the transoms 20A and 20C and the groove 222 is shifted downward relative to the engaging portion 25 of the outer batten 80 provided on the indoor side, when the holding piece 22 is cut by a hand tool such as a grinder in exchanging the glass plate 30 from the outdoor side, the grinder is not likely to touch the engaging portion 25. Accordingly, the cutting work of the holding piece can be easily and securely conducted, thereby improving workability.

(4) Since the pre-attached outdoor seal member 71 and the post-attached indoor seal member 72 have the same thickness in depth direction L1 and L2 of the held portions 71A and 72A, even when the seal member 71 is pre-attached to the indoor side and the seal member 72 is post-attached to the outdoor-side when the glass plate 30 is exchanged from the outdoor side, the position of the glass plate 30 stays the same in the depth direction. Accordingly, appearance of the exchanged part can be made uniform as the other non-exchanged part, so that good design effect can be maintained.

(5) Since the fin portions 71B and 72B having the same shape are attached to the seal members 71 and 72, the appearance of the respective seal members 71 and 72 can be made uniform, thereby also obtaining good design effect.

Incidentally, the scope of the present invention is not restricted to the above embodiment, but includes following modifications.

For instance, though the cover member 60 is attached to the transoms 20A and 20C in the above embodiment, the cover member according to the present invention may be attached to mullions when a curtain wall is arranged to hold a facing member such as glass plate by an inner batten engaged to the mullion.

Figure 6:
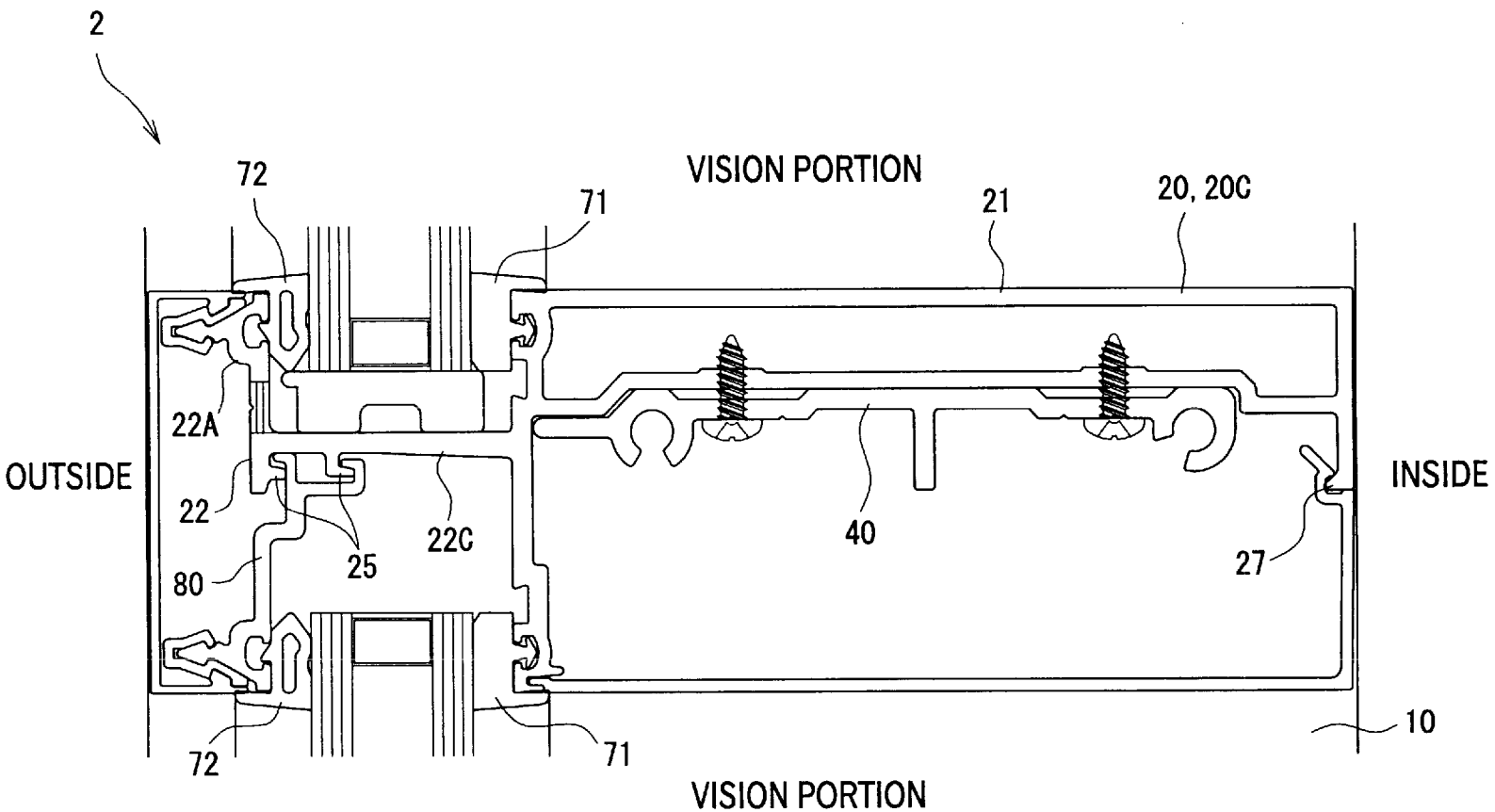
FIG. 6 is a vertical cross section for illustrating a modification of the present invention.

Further, the outer batten 80 (FIG. 5) of the above embodiment may be supplied from the stocked material for repair use, when the outer batten 80 of the same configuration is used in a curtain wall 2 of outside glazing as shown in FIG. 6, the outer batten 80 may be applied.

Figure 7:
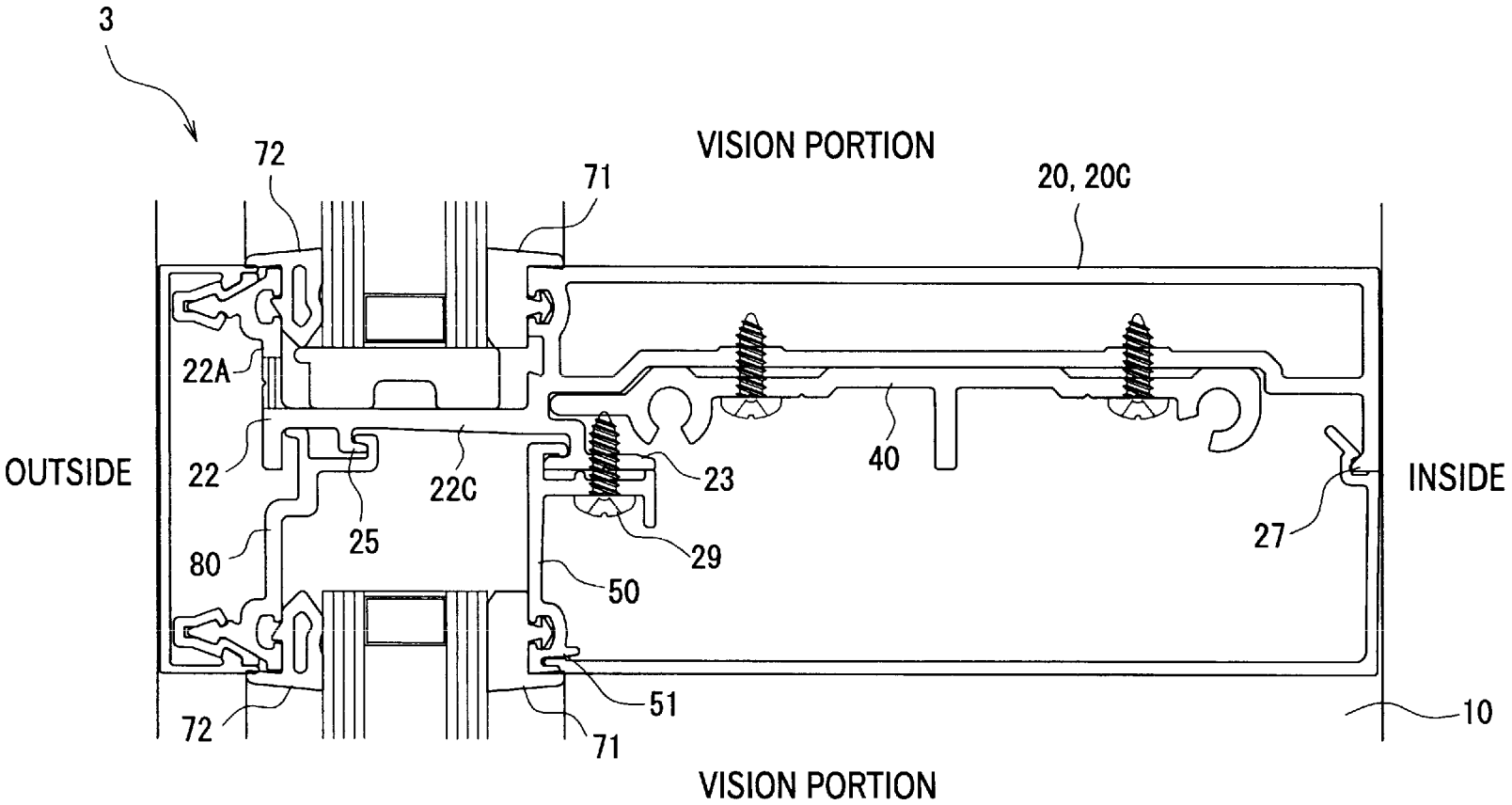
FIG. 7 is a vertical cross section for illustrating another modification of the present invention.

Further, as shown in FIG. 7, when the outer batten 80 and the inner batten 50C fixed to the first engaging portion 23 of the transom 20C by the vis 29 respectively of the same configuration are used in an outside glazing curtain wall 3, the outer batten 80 and the inner batten 50C may be applied and the transom 20C also may be applied.

The transom 20A, the inner batten 50A, the cover member 60 of the present embodiment may also use the component used in the curtain wall of outside glazing.

Though a plurality of layers of glass plate 30 is fitted in the vision portion, single-glazing glass plate 30 may be used in the vision portion. In this case, the arrangement for holding lower periphery and right and left periphery of single-glazing glass plate 30 is substantially the same as the holding structure using the glazing adapter 52 of the above embodiment.

The mullion 10 and the transom 20 may have a cross section dedicated for the single-glazing glass plate 30. In this case, the glazing adapter 52 is not necessary.

The facing member is not restricted to the glass plate 30 but any material including metal panel such as aluminum and stone panel may be used.

The wall structure according to the present invention may be applied to any building wall such as store front of a shop in addition to the curtain wall.

What is claimed is:

1. A wall structure of a building, comprising:

a facing member disposed in a section formed by left and right mullions and upper and lower transoms;

an inner batten engaged to the mullion and/or the transom to hold the facing member from an indoor side, wherein a cover, being engaged with the transom, for covering an indoor side of the inner batten facing the section formed by the mullion and/or the transom is attachably provided, and a holding piece provided to an outdoor side of the mullion and/or the transom for holding the facing member from the outdoor side, an outdoor surface of the holding piece having a mark indicating a cutting position of the holding piece, an indoor surface of the holding piece having an engaging portion to be engaged with a post-attached outer batten in place of the cut holding piece, wherein the mark is provided inwardly in width direction relative to the engaging portion.

2. The wall structure of a building according to claim 1, wherein the facing member is held by the inner batten and the holding piece through seal members provided on the indoor side and the outdoor side respectively, the seal members having held portions of the same thickness in depth direction.

* * * * *